US006588319B2

(12) United States Patent
Maganhoto

(10) Patent No.: US 6,588,319 B2
(45) Date of Patent: Jul. 8, 2003

(54) CONNECTING ROD-PISTON MOUNTING ARRANGEMENT FOR A RECIPROCATING COMPRESSOR OF SMALL REFRIGERATION SYSTEMS

(75) Inventor: Sergio Luiz Maganhoto, Joinville-SC (BR)

(73) Assignee: Empresa Brasileira de Compressores S.A. - Embraco, Joinville-SC (BR)

( * ) Notice: Subject to any disclaimer, the term of this patent is extended or adjusted under 35 U.S.C. 154(b) by 121 days.

(21) Appl. No.: 09/956,666

(22) Filed: Sep. 19, 2001

(65) Prior Publication Data

US 2002/0014151 A1 Feb. 7, 2002

Related U.S. Application Data

(63) Continuation of application No. PCT/BR00/00026, filed on Mar. 22, 2000.

(30) Foreign Application Priority Data

Mar. 22, 1999 (BR) ..... 9901151

(51) Int. Cl.[7] ..... F16J 1/14
(52) U.S. Cl. ..... 92/187
(58) Field of Search ..... 92/187, 12.2

(56) References Cited

U.S. PATENT DOCUMENTS

| | | | | | |
|---|---|---|---|---|---|
| 1,345,808 | A | * | 7/1920 | Reynolds | 123/43 A |
| 1,787,638 | A | * | 1/1931 | Moore | 92/187 |
| 2,500,669 | A | | 3/1950 | Doeg | 309/20 |
| 2,964,365 | A | | 12/1960 | Hausch | 309/20 |
| 3,695,150 | A | * | 10/1972 | Salzmann | 92/187 |
| 4,070,122 | A | | 1/1978 | Wisner | 403/39 |
| 4,207,779 | A | * | 6/1980 | Papst | 92/187 |
| 4,905,577 | A | | 3/1990 | Schneeweiss | 92/158 |
| 4,913,001 | A | | 4/1990 | Watanabe et al. | 74/579 E |
| 6,425,316 | B1 | * | 7/2002 | Phan | 92/187 |

* cited by examiner

*Primary Examiner*—Edward K. Look
*Assistant Examiner*—Igor Kershteyn
(74) *Attorney, Agent, or Firm*—Darby & Darby

(57) ABSTRACT

A connecting rod-piston mounting arrangement for a reciprocating compressor of small refrigeration systems, in which one of the parts defined by the piston (10) and the end (22) of the connecting rod (20) adjacent the said piston (10) carries a first spherical seat (11) and a spherical annular seat (12), the other of said parts incorporating a second spherical seat (23) turned to the first spherical seat (11) and a spherical annular surface (24) seated against the spherical annular seat (12), said first and second spherical seats (11,23) being seated onto respective opposite spherical surface portions (31,32) of a ball joint element (30) provided between the piston (10) and the connecting rod (20).

8 Claims, 2 Drawing Sheets

CONNECTING ROD-PISTON MOUNTING ARRANGEMENT FOR A RECIPROCATING COMPRESSOR OF SMALL REFRIGERATION SYSTEMS

This is a continuation of international application Ser. No. PTC/BR00/00026 filed Mar. 22, 2000.

FIELD OF THE INVENTION

The present invention refers to a connecting rod-piston mounting arrangement for a reciprocating compressor of the type used in small refrigeration systems, such as refrigerators, freezers, drinking fountains, etc.

BACKGROUND OF THE INVENTION

The reciprocating compressors known in the art and used in refrigeration systems have a connecting rod, which is mounted, on one side, to an eccentric of a crankshaft journalled to a cylinder block and, on the other side, to a piston reciprocating inside a cylinder, orthogonally in relation to the eccentric axis.

As a function of the small size of the components and the exiguous space provided for mounting the piston-connecting rod-eccentric pin assembly, different constructive alternatives for the connecting rod have arisen, aiming at facilitating the mounting of this assembly to the compressor, such as those alternatives using a two-piece connecting rod, since it is easier to be mounted to the parts defined by the eccentric and the piston.

In these constructions, the parts defined by the connecting rod and the piston are articulated and connected to each other usually by pins, clamps or adhesives.

The known constructions of a two-piece connecting rod have inconveniences, such as: they require a high number of components; they are difficult to assemble; they permit the occurrence of high mass displacement; they generate residues, as in the case of welding or use of adhesive; and they require machining precision, which involves high manufacturing costs. When adhesives are used, there is also the inconvenience of requiring, sometimes, a long drying period. Moreover, the fixation by adhesive compromises the reliability of the product, since the adhesive presents a varying resistance with time, as a function of material aging. In another known constructive solution, the mounting of the connecting rod to the piston occurs by means of a spherical articulation, in which a metallic sphere is affixed, by an adequate process, to one of the ends of the connecting rod. In this construction, the sphere joined to the connecting rod is introduced into a cavity provided inside the piston and mechanically shaped so as to promote a locking of the sphere-connecting rod assembly inside the piston. In some cases, it is also used a fixation means to keep the parts of this assembly together, such as a synthetic resin, which is applied between the sphere and the inner wall of the piston, at the region close to the connecting rod.

This solution has, as disadvantage, the great difficulty in joining the sphere to the end of the connecting rod with quality and in a reliable way, besides causing high localized wear during the operation of the compressor.

DISCLOSURE OF THE INVENTION

Thus, it is an objective of the present invention to provide a connecting rod-piston mounting arrangement for a reciprocating compressor, which allows a simple and fast mounting of the connecting rod-piston assembly, by using components, which do not require high dimensional precision, which do not cause premature wear of the involved parts and which are capable of maintaining the reliability of the product.

A further objective of the present invention is to provide a construction of a connecting rod-piston assembly, in which these parts are kept coupled to each other in a reliable way, without requiring the application of fixation elements therebetween.

These objectives of the invention are attained through a connecting rod-piston mounting arrangement for a reciprocating compressor of small refrigeration systems, in which one of the parts defined by the piston and the end of the connecting rod adjacent the said piston carries a first spherical seat, which is turned to the other part, and a spherical annular seat, which is axially spaced, concentric and turned to the opposite direction in relation to the first spherical seat; the other of said parts incorporating a second spherical seat turned to the first spherical seat and a spherical annular surface seated against the spherical annular seat, the second spherical seat and the spherical annular surface being concentric to the axis of the respective part to which they are incorporated, said first and second spherical seats being seated onto respective opposite spherical surface portions of a ball joint element provided between the piston and the connecting rod, the part incorporating the second spherical seat being radially projected through the spherical annular seat.

BRIEF DESCRIPTION OF THE DRAWINGS

The invention will be described below, with reference to the attached drawings, in which.

BEST MODE OF CARRYING OUT THE INVENTION

The present invention will be described in relation to a connecting rod-piston arrangement of the type that operates in a reciprocating compressor used in small refrigeration systems.

Figure 1:
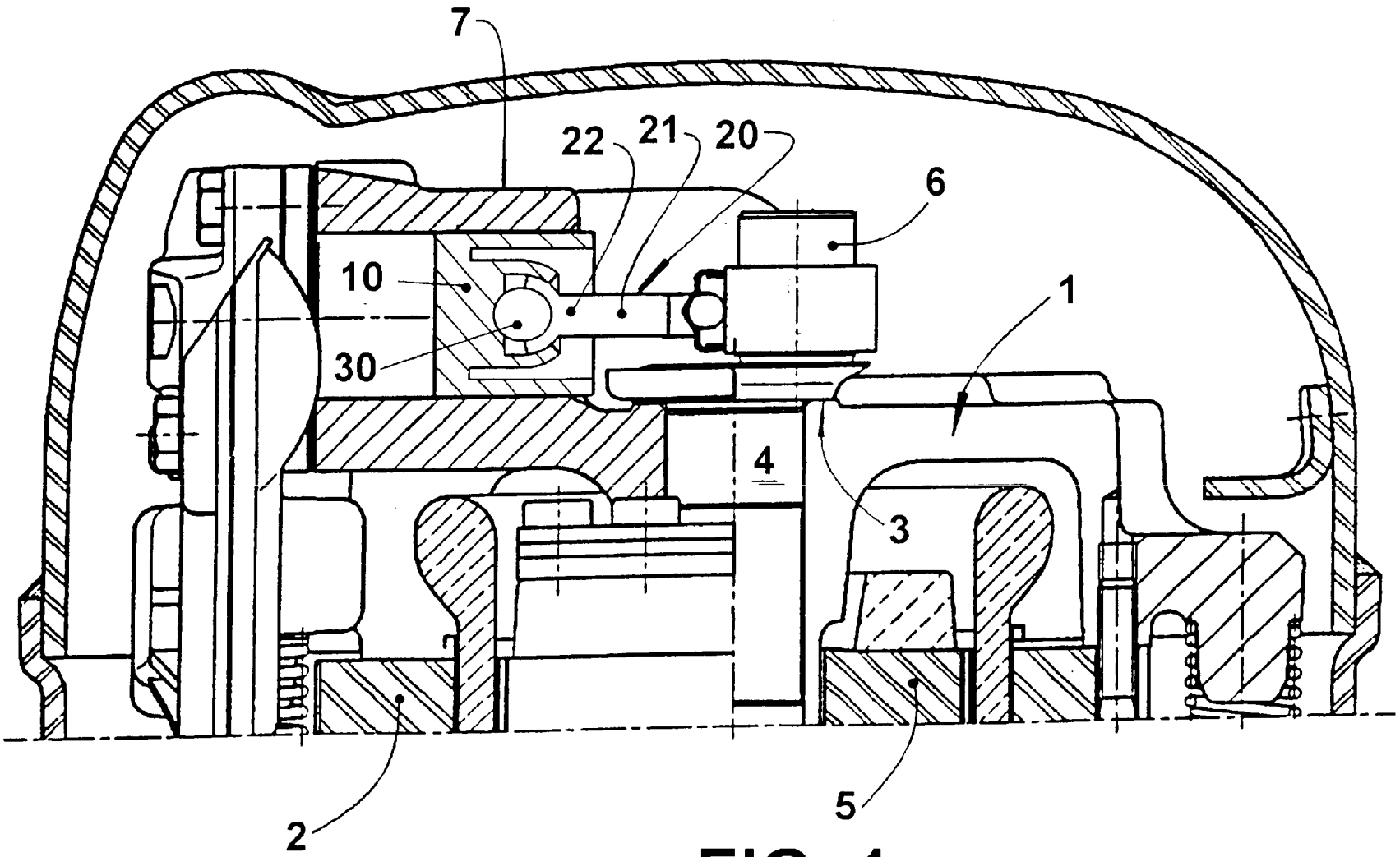
FIG. 1 shows, schematically, and in a longitudinal sectional view, part of the internal region of a reciprocating compressor, to which is mounted a piston-connecting rod-eccentric assembly of said compressor, said parts being joined together and with the connecting rod being constructed according to the present invention.
Figure 2:
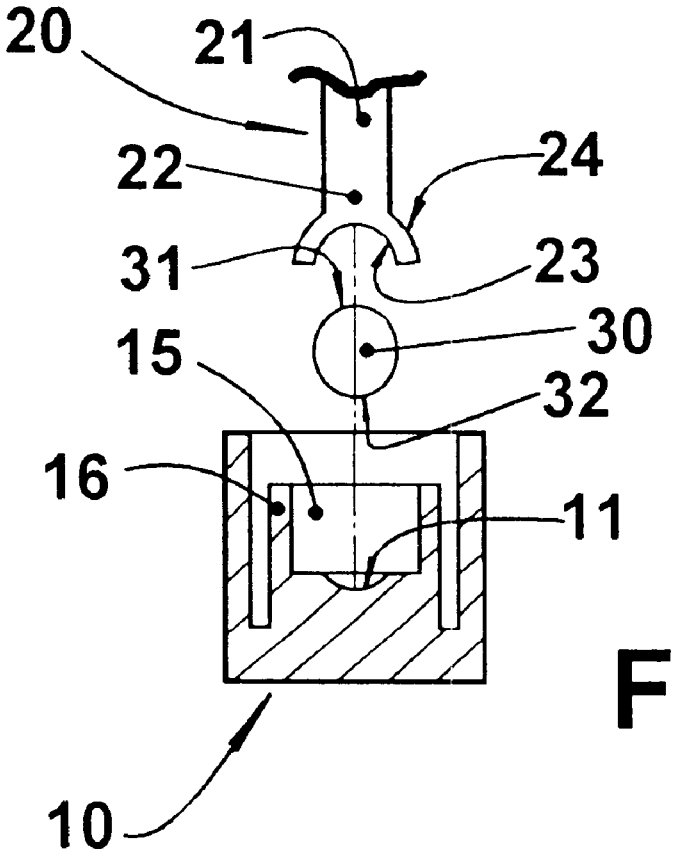
FIG. 2 shows, schematically, an exploded enlarged view of the connecting rod illustrated in FIG. 1, before its fixation to the piston.
Figure 3:
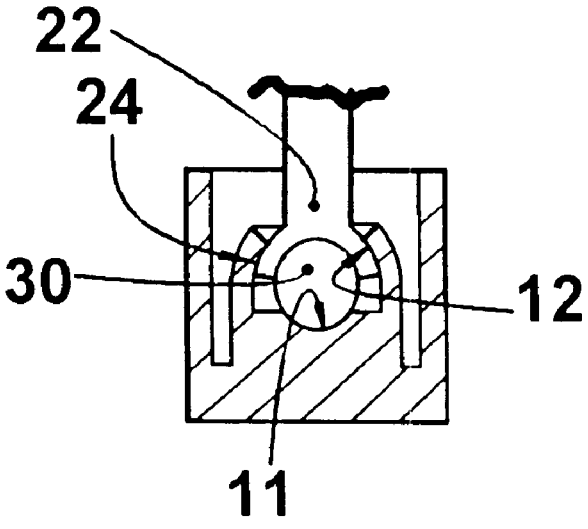
FIG. 3 shows, schematically, a view such as that illustrated in FIG. 2, with the connecting rod affixed to the piston.

According to FIG. 1, a reciprocating compressor of a motor-compressor assembly, usually mounted inside a hermetic shell, comprises a block 1, to which is mounted a stator 2 of the electric motor and which is provided with a bearing 3, for supporting a crankshaft 4, which carries, inferiorly, a rotor 5 of the motor and which has, at its upper end, an eccentric 6.

Block 1 further lodges a cylinder 7, in which inside reciprocates a piston 10, in an orthogonal travel in relation to the axis of the eccentric 6.

The connection between the piston 10 and the crankshaft 4 is achieved through a connecting rod 20 having a rod 21 with an end 22 to be articulated to the piston 10 and an opposite end, for example of a conventional construction, to be mounted to the eccentric 6.

According to the present invention, one of the parts defined by the piston 10 and the end 22 of the connecting rod 20 adjacent to the piston 10 carries a first spherical seat 11 facing the connecting rod 20 and a spherical annular seat 12, which is axially spaced, concentric and turned to the opposite direction in relation to the first spherical seat 11, whereas the other of said parts incorporates a second spherical seat 23, turned to the first spherical seat 11, and a spherical annular surface 24, to be seated against the spherical annular seat 12, upon mounting the connecting rod 20 to the piston 10.

In the illustrated construction, the piston 10 carries the first spherical seat 11 and the spherical annular seat 12, whereas the end 22 of the connecting rod 20 incorporates, concentrically to the axis thereof and defined in an enlarged portion of the end 22 of said connecting rod 20, the second spherical seat 23 and the spherical annular surface 24.

According to the present invention, between the first and the second spherical seats is positioned a ball joint element 30, for example a sphere, which is lodged inside the piston 10. The ball joint element 30 has opposite spherical surface portions 31, 32, each of the parts defined by the first and the second spherical seats being seated onto an adjacent and respective spherical surface portion 31, 32.

According to the mounting arrangement of the present invention, the fixation of the connecting rod 20 to the piston 10 occurs when the piston 10 surrounds the enlarged portion of the end 22 of the connecting rod 20. With this construction, the rod 21 of the connecting rod 20 projects radially through the spherical annular seat 12 of the piston 10, when the spherical annular surface 23 of the connecting rod 20 is tightly seated against said spherical annular seat 12.

In the illustrated construction, each of the first and second spherical seats has a respective edge turned to the other of said parts, upon mounting the connecting rod 20 to the piston 10, and which is contained in a plane transversal to the axis of the respective part where it is provided.

According to a constructive form of the present invention, each of the first and second spherical seats has a radius of curvature coinciding with that of the adjacent spherical annular surface portion 24 of the ball joint element 30, in order to be completely seated against the adjacent spherical surface portion 31, 32 of the ball joint element 30.

In the illustrated construction, the piston 10 defines, in its inside, a housing 15, which is opened to a mounting face of the piston 10, through which said piston is engaged to the connecting rod 20, in order to receive and retain, upon mounting of the connecting rod-piston assembly, the end 22 of the connecting rod 20.

Inside the housing 15 is defined the first spherical seat 11, which houses the ball joint element 30.

The retention of the end 22 of the connecting rod 20 in the housing 15 is obtained by shaping, by an adequate process, such as for example, a mechanical process, a tubular wall 16 of said housing 15, which tubular wall 16 is recessed in relation to the edge of the face of the piston 10 to be mounted to the connecting rod 20, so that a front edge portion of said tubular wall 16 be seated around the enlarged portion of the end 22, retaining the latter to the piston 10. The front edge portion of the tubular wall 16 defines the spherical annular seat 12.

The present solution provides an articulated connecting rod-piston mounting arrangement using a sphere, which is reliable and easy to construct and assemble. Moreover, with the present construction, no localized wear occurs between the parts with relative movement during the operation of the compressor, since the sphere 30 rotates freely inside the housing.

What is claimed is:

1. A connecting rod-piston mounting arrangement for a reciprocating compressor of small refrigeration systems, characterized in that one of the parts defined by the piston (10) and the end (22) of the connecting rod (20) adjacent the said piston (10) carries a first spherical seat (11), which is turned to the other part, and a spherical annular seat (12), which is axially spaced, concentric and turned to the opposite direction in relation to the first spherical seat (11);

the other of said parts incorporating a second spherical seat (23) turned to the first spherical seat (11) and a spherical annular surface (24) seated against the spherical annular seat (12), the second spherical seat (23) and the spherical annular surface (24) being concentric to the axis of the respective part to which they are incorporated, said first and second spherical seats (11, 23) being seated onto respective opposite spherical surface portions (31,32) of a ball joint element (30) provided between the piston (10) and the connecting rod (20), the part incorporating the second spherical seat (23) being radially projected through the spherical annular seat (12) said spherical annular seat (12) being defined by the seating of a front edge portion of a tubular wall (16) of the respective part around the spherical annular surface (24).

2. The mounting arrangement of claim 1, characterized in that each of the first and second spherical seats (11,23) has a respective edge turned to the other of said parts and which is contained in a plane transversal to the axis of the respective part where it is provided.

3. The mounting arrangement of claim 2, characterized in that each of the first and second spherical seats (11,23) has a radius of curvature coinciding with that of the adjacent spherical surface portion (31,32) of the ball joint element 30.

4. The mounting arrangement of claim 3, characterized in that the first spherical seat (11) and the spherical annular seat (12) are defined inside the piston (10).

5. The mounting arrangement of claim 1, characterized in that said end (22) of the connecting rod (20) has an enlarged portion defining the second spherical seat (23) and the spherical annular surface (24).

6. The mounting arrangement of claim 1, characterized in that the ball joint element (30) is a sphere.

7. The mounting arrangement of claim 1, characterized in that the tubular wall (16) is provided in a housing (15) and recessed in relation to the edge of the face of the respective part.

8. The mounting arrangement of claim 7, characterized in that the housing (15) is defined inside the piston (10).

* * * * *